US006745705B1

(12) United States Patent
Benesch et al.

(10) Patent No.: US 6,745,705 B1
(45) Date of Patent: Jun. 8, 2004

(54) FURNACE

(75) Inventors: Wolfgang Benesch, Bochum (DE); Reinhold Terhaar, Hattingen (DE)

(73) Assignee: Steag Encotech GmbH (DE)

( * ) Notice: Subject to any disclaimer, the term of this patent is extended or adjusted under 35 U.S.C. 154(b) by 0 days.

(21) Appl. No.: 10/048,817

(22) PCT Filed: Jul. 28, 2000

(86) PCT No.: PCT/EP00/07262

§ 371 (c)(1),
(2), (4) Date: Mar. 1, 2002

(87) PCT Pub. No.: WO01/09549

PCT Pub. Date: Feb. 8, 2001

(30) Foreign Application Priority Data

Aug. 3, 1999 (DE) ..... 199 35 597

(51) Int. Cl.[7] ..... F23J 1/00
(52) U.S. Cl. ..... 110/165 A; 110/165 R
(58) Field of Search ..... 110/168, 169, 110/165 A, 204, 205, 165 R

(56) References Cited

U.S. PATENT DOCUMENTS 4,389,978 A * 6/1983 Northcote ..... 122/4 D
4,503,783 A * 3/1985 Musschoot ..... 110/165 R
4,724,779 A * 2/1988 White et al. ..... 110/281
5,775,237 A * 7/1998 Reilly et al. ..... 110/234

* cited by examiner

*Primary Examiner*—Ira S. Lazarus
*Assistant Examiner*—K. B. Rinehart
(74) *Attorney, Agent, or Firm*—R W Becker & Associates; R W Becker

(57) ABSTRACT

The invention relates to a furnace with a body (1) of a furnace, at the lower end of which a discharge device (2) for the ashes produced in the combustion chamber is provided. A continuous conveyor device in the form of a vibrating conveyor (3) is mounted below the discharge device (2). The vibrating chute of said vibrating conveyor reliably and effectively removes the dry ashes which are at the same time cooled with air.

10 Claims, 1 Drawing Sheet

FURNACE

BACKGROUND OF THE INVENTION

The invention relates to a furnace having a firebox, at least one discharge device disposed at the lower end of the firebox for combustion chamber ash, and a conveyor disposed below the discharge device for the receipt and removal of the discharged ash in a dry state.

The combustion chamber ash, which is withdrawn at the bottom from the firebox, is obtained at a temperature of 800 to 1200° C. One originally allowed the combustion chamber ash to fall into a water bath, from which it was withdrawn via the conveyor. With modern low $NO_x$ furnaces, the ash quality has changed such that the subsequent transfer process would be problematic due to the absence of an ability to remove water from the ash. In addition, there were storage and removal problems.

On the basis of this background, a dry ash removal process was developed with which the problem of removing water from the combustion chamber ash was eliminated. In addition, the dry ash can be better reused or, after appropriate processing, can even be mixed with the filter ash. In this way there results a uniform removal mode for the entire ash of the bituminous coal furnace.

The known dry ash removal process is operated with a bituminous coal furnace that is described in a prospectus of the U.S. American company United Conveyor Corporation from the year 1997. The ash is collected on screens or grids, and is introduced by batches into a vacuum transfer system.

The object of the invention is to improve the cooling of the combustion chamber ash as well as the handling, removal and utilization thereof.

SUMMARY OF THE INVENTION

To realize this object, the initially mentioned furnace is inventively characterized in that the conveyor is embodied as a continuous-flow conveyor, and a device for cooling the ash by means of air is provided.

It is proposed pursuant to an important further development of the invention that the continuous-flow conveyor be embodied as a vibrating conveyor and have a vibrating trough that is open toward the discharge device.

Vibrating conveyors are extremely sturdy, which is of great significance with regard to the abrasive characteristics of combustion chamber ash. In addition, such conveyors have high conveying capacities and readily permit not only a discontinuous as well as a continuous operation, in other words, a very variable and effective dry ash removal process.

Above everything else, vibrating conveyors can be combined with a very effective air cooling. Thus, the temperature of the combustion chamber ash can effectively, i.e. rapidly, be reduced to low values during the removal.

In this connection, it is to be emphasized that the inventive means for the removal and cooling of the combustion chamber ash are straightforward, economical and reliable in operation.

The invention is primarily usable with bituminous coal furnaces, although it is also usable on other furnaces, such as lignite or brown coal furnaces, refuse incinerators, etc.

Pursuant to a further development of the invention, it is proposed that the base of the vibrating trough be provided with nozzle openings for the cooling air. The cooling air passes through the ash deposited in the vibrating trough and can then pass into the firebox, in which it is utilized as preheated air for combustion. Alternatively, or in addition thereto, there is the advantageous possibility of providing the vibrating trough with lateral nozzle openings for the cooling air. This leads to a very intensive cooling of the upper surface of the ash deposit in the vibrating trough and of the ash-particles that have just dropped down. Also in this case there results preheated combustion air for the firebox. Finally, there is the possibility of also providing the discharge device with nozzle openings for the cooling air. Thus, the combustion chamber ash is already cooled in the counter flow prior to being deposited upon the vibrating conveyor, which leads to a very intensive cooling and preheating of the air for combustion.

The introduction of cooling air as preheated combustion air into the lower region of the firebox has an additional advantageous effect, namely an afterburning of the combustion chamber ash. This improves the combustion of the fuel (bituminous coal) furnace and reduces the amount of combustion chamber ash that is produced.

Depending upon the operating conditions, the underpressure that exists in the firebox can be sufficient to draw in the cooling air through the individual nozzles. However, under certain circumstances it is also advantageous to connect at least some of the nozzle openings to a blower. This can increase the throughput of cooling air and primarily leads to an improved controllability of the cooling process. The danger that the nozzle openings become clogged is also reduced.

In addition to the above discussed direct cooling of the combustion chamber ash, pursuant to a further development of the invention an indirect cooling is also proposed, whereby the vibrating trough is combined with an air receiver that is connected to the firebox. The cooling air thus passes against the underside of the trough and withdraws heat from the combustion chamber ash without coming in to contact with the latter. Since the air receiver is connected to the firebox, there again results preheated air for combustion.

It is readily possible within the scope of the invention to combine the indirect cooling of the combustion chamber ash with the direct cooling.

With the indirect cooling, it is advantageous to provide the underside of the vibrating trough with cooling ribs or the like in order to increase the heat transfer in a controlled manner.

Also with the indirect cooling the underpressure in the firebox can suffice to draw the cooling air through the air receiver. Alternatively, there exists the possibly more advantageous possibility of connecting the air receiver to a blower. The advantages relative thereto were already described in conjunction with the direct cooling.

To the extent that a blower is used, whether with the indirect or with the direct cooling, such a blower is preferably the fresh air blower that supplies combustion air to the firebox. A portion of this combustion air is thus branched off as cooling air and is introduced into the combustion chamber as preheated air, and in particular either directly or also after being returned to the combustion air stream.

Pursuant to a further development of the invention, it is proposed that the discharge device be provided with an angled-off outlet and that the vibrating conveyor is disposed below the angled-off outlet. This configuration effects a considerable contribution to the cooling process since the vibrating conveyor is not located in the direct radiation range of the firebox. This improves the cooling, i.e. reduces the required cooling capacity. In addition, it enables the use of fewer special or high-grade materials.

Pursuant to a further advantageous feature, the discharge device is provided with closure dampers that offer the possibility of delivering the combustion chamber ash to the vibrating conveyor in a batch-wise manner. Frequently, however, one will prefer a continuous ash discharge. In this case, the closure dampers then offer the possibility of temporarily storing the ash if brief disruptions occur in the region of the vibrating conveyor or if minor repairs or maintenance work must be carried out. This eliminates the need for having to shut down the furnace.

The main area of application of the invention is for bituminous coal furnaces in power plants for the generation of steam.

BRIEF DESCRIPTION OF THE DRAWINGS

The invention will be described in greater detail in the following with the aid of preferred embodiments in conjunction with the accompanying drawing. The drawing shows in.

DESCRIPTION OF THE PREFERRED EMBODIMENTS

Figure 1:
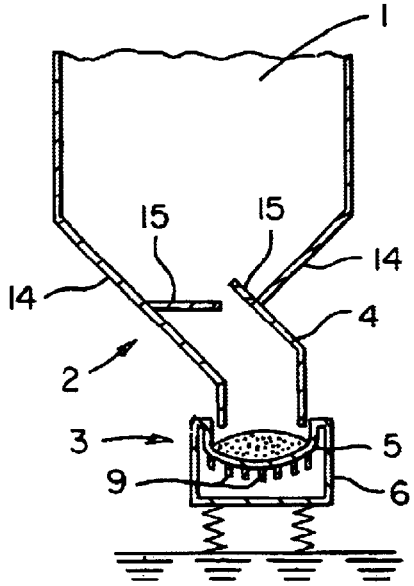
FIG. 1 in a schematic illustration, a cross-sectional view through a steam generator having a bituminous coal furnace.

The furnace of FIG. 1 has a firebox 1, at the lower end of which is disposed a discharge device 2 for ash from the combustion chamber. Located below the discharge device 2 is a vibrating conveyor 3, the direction of conveying of which extends perpendicular to the plane of the drawing.

The discharge device 2 has an angled-off outlet 4, so that the vibrating conveyor 3 has an offset arrangement and is not disposed in the direct range of radiation of the firebox 1. Thus, the vibrating conveyor 3 is thermally shielded. A non-offset arrangement is also possible.

Figure 2:
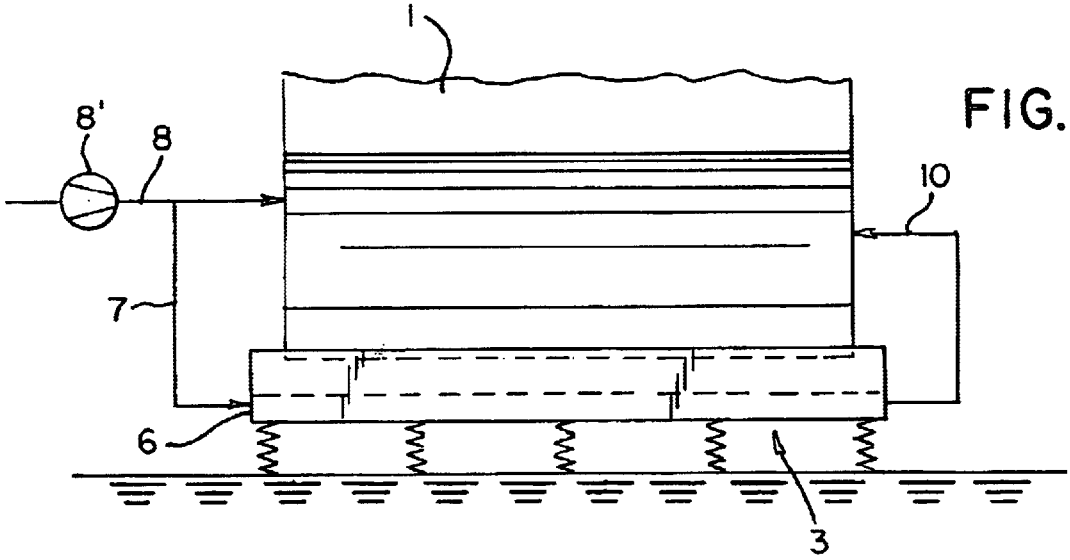
FIG. 2 a side view of the furnace of FIG. 1.

The vibrating conveyor 3 has a vibrating chute or trough 5 that is disposed in an air receiver or box 6. As indicated in FIG. 2, the air receiver 6 is supplied with compressed air, and in particular via a line 7 that branches off from a combustion air line 8. The air flows along below the vibrating trough 5 and effects an indirect cooling of the ash that is transported in the vibrating trough. To improve the transfer of heat, the underside of the vibrating trough 5 is provided with cooling ribs 9.

The air that is conveyed through the air receiver 6 is introduced as preheated air for combustion into the furnace 1, and in particular in the present case via a separate line 10. Alternatively, the preheated air for combustion can also be returned to the combustion air line 8 and from there can pass either directly or via the burners into the firebox.

Figure 3:
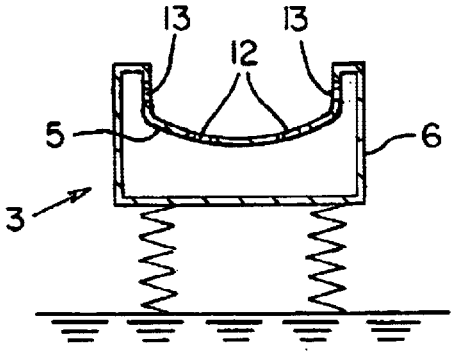
FIG. 3 is a cross-sectional view through a modified embodiment of a vibrating conveyor.

In contrast to the indirect cooling of the ash pursuant to FIGS. 1 and 2, the vibrating conveyor 3 of FIG. 3 operates with direct cooling. For this purpose, provided in the base of the vibrating trough 5 are nozzle openings 12 that blow the cooling air through the removed ash. Further nozzle openings 13 are provided in the side walls of the vibrating trough 5 in order to blow cooling air onto the upper side of the ash and at the same time to cool ash particles that drop down.

FIG. 1 further shows that the discharge device 2 is also provided with nozzle openings 14. These cool the ash particles that drop down in counter current, in other words, in a very effective manner, and furthermore effect an afterburning of the ash, which minimizes the quantity of ash. Further cooling air openings can be associated with the furnace or with the steam generator.

FIG. 1 finally shows that the discharge device 2 is provided with closure dampers 15, of which the left one is closed for illustration purposes and the right one is illustrated as being half closed. The closure dampers 15 permit a discontinuous operation and during continuous operation enable the brief elimination of tisturbances in the region of the vibrating conveyor without it being necessary to shut down the boiler plant.

Modifications are readily possible within the scope of the invention. For example, the indirect cooling can be combined with the direct cooling. Furthermore, it is possible to operate with separate cooling air blowers. Under certain circumstances, it is possible to dispense with any blower support to the extent that the underpressure in the furnace is sufficient for drawing in the cooling air. However, a blower support has the advantage that appropriately high flow velocity in the nozzle openings can contribute to preventing the nozzle openings from becoming clogged. This is also applicable for the nozzle openings that are disposed in the region of the discharge device. If a blower support is dispensed with, then the air receiver of the embodiment of FIG. 3 can be eliminated. It is furthermore possible for a further vibrating conveyor to adjoin the vibrating conveyor of FIG. 2, with this further vibrating conveyor also being provided with a cooling device, whereby the two cooling devices can readily have different configurations.

The specification incorporates by reference the disclosure of German priority document 199 35 597.5 filed Aug. 3, 1999 and International priority document PCT/EP00/07262 of Jul. 28, 2000.

The present invention is, of course, in no way restricted to the specific disclosure of the specification and drawings, but also encompasses any modifications within the scope of the appended claims.

What is claimed is:

1. A furnace comprising:

a firebox;

at least one discharge device disposed at a lower end of said firebox for dry ash from a combustion chamber of said firebox;

a continuous-flow conveyor, in the form of a vibrating conveyor, disposed below said discharge device for receiving and removing discharged ash in a dry state, wherein said conveyor is provided with a vibrating trough that is open toward said at least one discharge device, and wherein said vibrating trough forms an upper wall of an air receiver that adjoins said firebox;

means for cooling said ash with air, wherein cooling air is utilized as preheated combustion air for said firebox, and wherein a base of said vibrating trough is provided with nozzle openings for the passage of cooling air; and a blower, wherein said air receiver is connected to said blower.

2. A furnace according to claim 1, wherein an underside of said vibrating trough is provided with cooling means.

3. A furnace according to claim 2, herein said cooling means are cooling ribs.

4. A furnace according to claim 1 wherein said blower is also a combustion air blower.

5. A furnace according to claim 1, wherein said at least one discharge device is provided with an angled-off outlet, and wherein said conveyor is disposed below said outlet.

6. A furnace according to claim 1, wherein said at least one discharge device is provided with closure dampers.

7. A furnace comprising:

a firebox;

at least one discharge device disposed at a lower end of said firebox for dry ash from a combustion chamber of said firebox;

a continuous-flow conveyor, in the form of a vibrating conveyor, disposed below said discharge device for receiving and removing discharged ash in a dry state, wherein said conveyor is provided with a vibrating trough that is open toward said at least one discharge device, wherein said vibrating trough is provided with lateral nozzle openings for cooling air, and wherein said vibrating trough forms an upper wall of an air receiver that adjoins said firebox; and means for cooling said ash with air, wherein cooling air is utilized as preheated combustion air for said firebox, and wherein a base of said vibrating trough is provided with nozzle openings for the passage of cooling air.

8. A furnace according to claim 7, wherein said discharge device is provided with nozzle openings for cooling air.

9. A furnace according to claim 8, wherein a blower is provided, and wherein at least some of said nozzle openings are connected to said blower.

10. A furnace comprising:

a firebox;

at least one discharge device disposed at a lower end of said firebox for dry ash from a combustion chamber of said firebox;

a continuous-flow conveyor, in the form of a vibrating conveyor, disposed below said discharge device for receiving and removing discharged ash in a dry state, wherein said conveyor is provided with a vibrating trough that is open toward said at least one discharge device, and wherein said vibrating trough forms an upper wall of an air receiver that adjoins said firebox; and means for cooling said ash with air, wherein cooling air is utilized as preheated combustion air for said firebox, wherein a base of said vibrating trough is provided with nozzle openings for the passage of cooling air, and wherein said cooling air is introduced as preheated combustion air into a stream of combustion air.

* * * * *